US005224787A

United States Patent [19]

Vasas

[11] Patent Number: 5,224,787

[45] Date of Patent: Jul. 6, 1993

[54] THREADED COSMETICS APPLICATOR WITH FEED CHANNELS

[75] Inventor: Martin M. Vasas, Fairfield, Conn.

[73] Assignee: The Bridgeport Metal Goods Manufacturing Co., Bridgeport, Conn.

[21] Appl. No.: 878,759

[22] Filed: May 5, 1992

[51] Int. Cl.[5] ..... A45D 40/00

[52] U.S. Cl. ..... 401/119; 132/218; 401/128; 401/129; 401/130

[58] Field of Search ..... 401/122, 126, 119, 129, 401/130, 128; 132/218

[56] References Cited

U.S. PATENT DOCUMENTS

| | | | |
|---|---|---|---|
| 532,359 | 1/1895 | Bradley | 401/119 X |
| 2,007,245 | 7/1935 | Gimonet | 132/218 |
| 2,990,563 | 7/1961 | Davidson | 401/128 X |
| 3,033,213 | 5/1962 | Joss, et al. | 132/218 X |
| 3,908,675 | 9/1975 | Spatz et al. | 401/122 X |
| 4,572,224 | 2/1986 | Rosenwinkel et al. | 132/218 |
| 4,898,193 | 2/1990 | Gueret | 132/218 |
| 4,927,281 | 5/1990 | Gueret | 132/218 X |

FOREIGN PATENT DOCUMENTS

| | | | |
|---|---|---|---|
| 883900 | 7/1943 | France | 132/218 |
| 2737667 | 2/1979 | France | 401/122 |

*Primary Examiner*—Steven A. Bratlie

*Attorney, Agent, or Firm*—Parmelee, Bollinger & Bramblett

[57] ABSTRACT

A cosmetics applicator comprises a rod having a threaded portion on the distal end of the rod, and characterized by a plurality of feed channels extending along the length of the rod and transected the threads. The space between the transecting threads and the portion of the feed channel lying below the depth of the threads carries an additional reservoir of cosmetics, and comb points are formed at the tips of the transecting threads for better separating eyelashes. The threaded cosmetics applicator with feed channels is particularly well adapted for applying mid-weight thixotropic mascaras to eyelashes.

8 Claims, 1 Drawing Sheet

THREADED COSMETICS APPLICATOR WITH FEED CHANNELS

This invention relates to a cosmetics applicator and more particularly, to a cosmetics applicator including feed channels, which is well adapted to apply thixotropic mascara to eyelashes.

BACKGROUND OF THE INVENTION

Spiral bristled brushes are generally used in the cosmetics industry to apply light weight and medium weight mascara. The spiral brushes work best with the lighter weight, relatively liquid mascara products, which spread somewhat evenly over the bristles for transfer to the eyelashes.

Threaded rod applicators are also known in the cosmetics industry and are used with highly viscous products. These heavy products are carried in the grooves defined by the threads, and eyelashes are dragged over the product, some of which rubs off onto the lashes. Some combing action is achieved, and the combing action becomes more pronounced as the product is used and the grooves become exposed through displacement of the heavy mascara product. However, combing action is limited until enough product is used to more fully expose the screw threads.

As noted above, medium weight, or fixatropic, mascaras can be applied by spiral brush, but the spiral brush has limitations when utilized for that purpose. Thixotropic mascaras are those of medium viscosity, which are flowable but are also capable of assuming and maintaining a three dimentional shape without exterior support. An example of an equivalent weight product is mayonnaise, which can reside in a globule of relatively stable size and dimension, but can also be spread. Some thixotropic mascaras are whipped or aerated, much as whipping cream, and some are gelled.

When thixotropic mascaras are applied to a spiral brush in a container and the brush is removed from the container through a wiper diaphragm, the product is substantially removed from the ends of the brush and is therefore not available for ready application to eyelashes. Thus, a fairly deep combing action may be required to apply the product, and because the product has some tendency to reside in globules, the application may not be uniform. Further, because of the spiral configuration of most brushes, there is a "directional rotation" imparted to the eyelashes, which may cause separation and unevenness where a more parallel orientation is desired.

Thus, neither spiral brushes nor present threaded applicators are fully satisfactory for applying mid-weight cosmetics, and particularly mid-weight thixotropic mascaras.

SUMMARY OF THE INVENTION

Accordingly, it is a principal object of the invention herein to provide an improved cosmetics applicator.

It is another object of the invention herein to provide a cosmetics applicator adapted for use with mid-weight, thixotropic cosmetics products.

It is a further object of the invention herein to provide a cosmetics applicator which carries a substantial amount of cosmetics product.

It is an additional object of the invention herein to provide a cosmetics applicator which achieves good combing action with respect to eyelashes.

It is yet another object of the invention herein to provide a cosmetics applicator which achieves well-controlled application of the cosmetics product.

A cosmetics applicator according to the invention herein comprises an elongated rod having threads formed along the exterior of the rod extending from the distal end thereof, with the threads defining grooves therebetween. At least one feed channel extends generally along the elongated rod and transects the threads formed thereon when dipped in mascara product and wiped. The mascara is carried in the threads and feed channels. The application of a mid-weight, thixotropic cosmetics product to eyelashes is well controlled as the lashes are bathed in the product carried in the grooves, and the feed channels carry an additional reservoir of product for direct application to the lashes or indirect application by migration into the grooves. Further, the transection of the threads by the feed channel creates points which enhance the combing action of the cosmetics applicator.

According to additional aspect of the invention, the feed channels may be deeper than the grooves of the threads, and the feed channels may have a rectangular cross-section with spaced apart, generally radially disposed sidewall portions. The plurality of feed channels may be three or four.

These and other more specific features and objects of the invention herein will in part be recognized by those skilled in the art and will in part appear from a perusal of the following description of the preferred embodiments and claims, taken together with the drawings.

DRAWINGS

The same referenced numerals refer to the same elements throughout the various figures.

DESCRIPTION OF PREFERRED EMBODIMENTS

Figure 1:
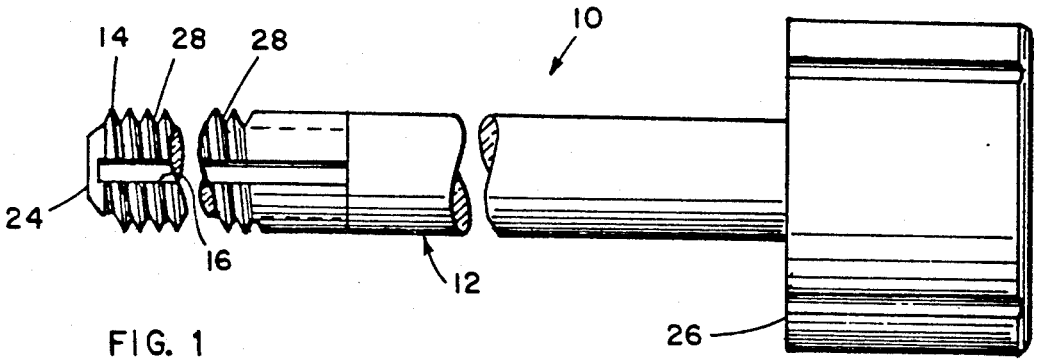
FIG. 1 is a side elevation view, partially cut away, of a cosmetics applicator according to the invention herein.
Figure 2:
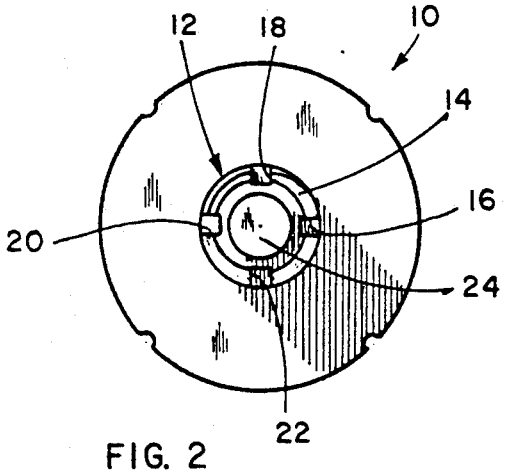
FIG. 2 is an end view of the cosmetics applicator of FIG. 1.

The invention herein relates to a cosmetics applicator, and particularly to a cosmetics applicator which is useful in applying medium weight mascara to eyelashes. FIGS. 1–4 illustrate a cosmetics applicator 10 according to the invention. The cosmetics applicator 10 generally comprises a rod 12 having threads 14 thereon extending from one end, and a plurality of feed channels 16, 18, 20 and 22 transecting the threads 14. A rounder tip 24 is provided at the threaded end of the rod 12. A handle 26 is provided at the end of the rod opposite the threads 14, and the handle also comprises a threaded cap for a cosmetics container. Thus, the threaded applicator 10 may be inserted in a container containing cosmetics, not shown, through a flexible wiper diaphragm mounted at the neck of the bottle. The opening in the flexible wiper diaphragm seals to the rod and also wipes excess cosmetics from the threads as the cosmetics applicator 10 is withdrawn, as is well known in the art.

The threads 14 are formed in a helix on the surface of the rod and extend from the end of the rod opposite the handle/cap 26. In the embodiment shown in FIGS. 1–4, the outer diameter of the threads is 0.18 inches and there are 32 threads per inch with a lead of 0.03125 inches. The threads are 0.027 deep. The threaded portion of rod 12, partially cut away is FIGS. 1 and 3, extends approximately 0.75 inches from the tip 24 toward the handle/-cap 26. The threads of course define valleys or "grooves" therebetween, which are indicated at 28.

As used herein, the term "threaded" encompasses the traditional helix threads which constitute the preferred embodiments of the invention because of the convenience in manufacturing the same. However, the term "threaded" is also meant to encompass closely spaced apart encircling ribs having a cross section similar to threads, so as to define grooves therebetween, or to other such similar shapes which may be selected when the rod 12 is molded rather than manufactured on a screw machine.

Figure 3:
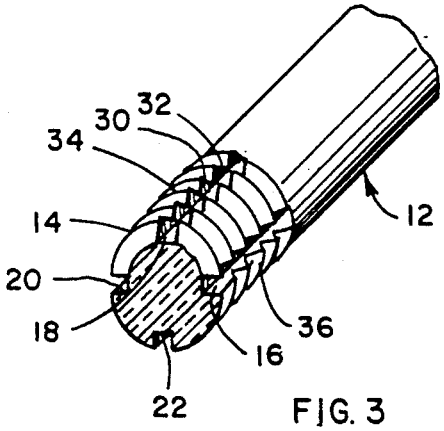
FIG. 3 is a perspective view of a segment of the threaded portion of the cosmetics applicator of FIG. 1.

The cosmetics applicator 10 further defines the feed channels 16, 18, 20 and 22 transecting the threads 14. The feed channels are deployed at 90 degree intervals about the rod, and extend from the rounded tip 24 along the length of the threads 14. The feed channels 16, 18, 20 and 22 are 0.032 inches wide and 0.032 inches deep, i.e., slightly deeper than the thread depth. As best seen in FIG. 3, the feed channels create spaces where the threads are interrupted, such as space 30 and 32, which spaces are in ready communication with the adjacent grooves of the threads. Further, the transecting feed channels cause there to be defined points, including points 34 and 36, at the tip of each interrupted thread.

For manufacturing convenience, the threaded portion of rod 12 may be formed as a machined metal piece including a stem, and the remainder of the rod may be formed of plastic including a pocket for receiving the stem and mounting the metal threaded portion thereon.

Figure 4:
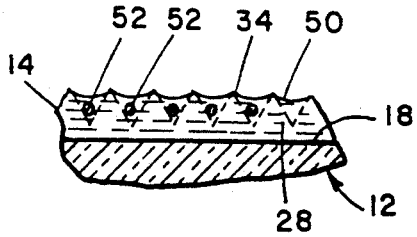
FIG. 4 is an enlarged fragmentary sectional view of a portion of the threaded applicator of FIG. 1, shown carrying a cosmetics product and applying the cosmetics product to eyelashes.

The operation of the cosmetics applicator 10 is illustrated in FIG. 4. The cosmetics applicator 10 with its feed channels is particularly well adapted for applying fixatropic cosmetics, such as mid-weight mascaras.

Thixotropic mascaras are those of medium viscosity, which are flowable but are also capable of assuming and maintaining a three dimensional shape without exterior support. An example of an equivalent weight product is mayonnaise, which can reside in a globule of relatively stable size and dimension, but can also be spread. Some thixotropic mascaras are whipped or aerated, much as whipping cream, and some are gelled.

In FIG. 4, the cosmetics is identified by the reference numeral 50, and eyelashes are identified by the reference numeral 52. When the cosmetics applicator 10 is withdrawn from a supply of cosmetics 50, and is also wiped in accordance with the usual procedures in the art, a supply of the cosmetics 50 is carried in the grooves 28 defined by the threads 14, as shown in FIG. 4.

Additionally, a further supply or reservoir of cosmetics 50 is carried in the feed channels 16, 18, 20 and 22, both in the lower portions of the feed channel and in the spaces defined between the threads interrupted by the feed channel. The cosmetics applicator 10, so loaded with cosmetics 50, is then applied to the base of the eyelashes and pulled along the length of the eyelashes. The eyelashes enter the grooves defined by the threads, and are bathed in the cosmetics 50 stored therein, which is partially transferred to the eyelashes. As the portion of the mascara is transferred to the eyelashes, the supply of mascara in the grooves is replenished from the feed channel.

A cosmetics applicator 10 is also useful in applying mascara in that the points 34, and similar points on the other threads, act as a form of comb teeth, to separate eyelashes and ensure that each eyelash is individually coated with cosmetics.

Figure 5:
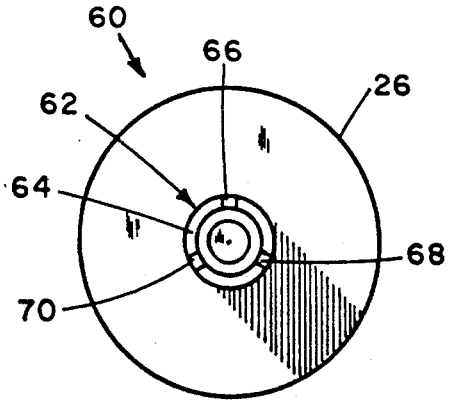
FIG. 5 is an end view of another cosmetics applicator according to the invention herein.

An additional cosmetics applicator 60 according to the invention herein is illustrated in FIG. 5. It is similar to the cosmetics applicator 10 described in FIGS. 1 through 4 above, and includes a rod 62 with a threaded portion 64 extending from the distal end. However, only three feed channels 66, 68 and 70 are provided transecting the threads, the three feed channels being deployed one hundred and twenty degrees apart. The particular dimensions of the cosmetics applicator 60 include a 0.140 inch outside thread diameter with forty threads per inch and a 0.025 inch lead. The thread depth is 0.022 inches and the feed channels are 0.025 inches wide by 0.025 inches deep. The thread portion is approximately 0.75 inches long.

It will be appreciated that the feed channels are preferably deeper than the threads, so that the bottom of the channel does not interrupt wiping action and combing, and the channel also provides additional carrying capacity at the bottom of the grooves. The number of feed channels is selected so as to leave a sufficient amount of uninterrupted thread for combing and application purposes, with the feed channels providing the additional supply of mascara for other cosmetic product.

Accordingly, the preferred embodiments of cosmetics applicators described herein above admirably achieve the objects of the invention herein. It will be appreciated that the preferred embodiments are illustrative only, and that changes may be made by those skilled in the art without departing from the spirit and scope of the invention, which is limited only by the following claims.

I claim:

1. A cosmetics applicator comprising:

A) an elongated rod;

B) said rod having threads formed along the exterior of a threaded portion of the rod extending from one end thereof, the threads defining grooves there between; and c) at least one feed channel extending generally along the elongated rod and transecting the threads formed thereon, said feed channel having a rectangular cross sectional shape and being deeper than said threads.

2. A cosmetics applicator as defined in claim 1 and further comprising:

D) a handle mounted to the end of the rod opposite the threads formed thereon.

3. A cosmetics applicator as defined in claim 2 wherein said handle is a cap adapted to close a bottle containing cosmetics with the rod extending therein.

4. A cosmetics applicator as defined in claim 1 wherein the threaded portion of the rod is manufactured of machined metal and the remaining portion of the rod is fabricated of a plastic material to which the metal portion is mounted.

5. A cosmetics applicator as defined in claim 1 wherein the at least one feed channel is at least as wide as it is deep.

6. A cosmetics applicator as defined in claim 1 wherein the at least one feed channel comprises a plurality of feed channels aligned with the axis of and evenly spaced about the threaded portion of the rod.

7. A cosmetics applicator as defined in claim 1 wherein the rod has a diameter in the range of 0.15 to 0.20 inches and the threads have a depth in the range of 0.020 inches–0.030 inches, the at least one feed channel is deeper than the threads and the at least one feed channel is at least as wide as it is deep.

8. A cosmetics applicator as defined in claim 1 wherein the threaded portion of the rod is approximately 0.75 inches in length.

* * * * *